US008242396B2

(12) United States Patent
Chen et al.

(10) Patent No.: US 8,242,396 B2
(45) Date of Patent: Aug. 14, 2012

(54) KEYPAD ASSEMBLY AND METHOD FOR MAKING THE SAME

(75) Inventors: Hsu-Tang Chen, Santa Clara, CA (US); Wen-Te Lai, Taipei Hsien (TW); Hsiang-Jung Su, Taipei Hsien (TW); Liang Xiong, Shenzhen (CN); Kai-Ming Guo, Shenzhen (CN); You-Li Liu, Shenzhen (CN); Jian-Hua Wu, Shenzhen (CN); Zhao-Long Zheng, Shenzhen (CN)

(73) Assignees: Shenzhen Futaihong Precision Industry Co., Ltd., ShenZhen, Guangdong Province (CN); FIH (Hong Kong) Limited, Kowloon (HK)

( * ) Notice: Subject to any disclaimer, the term of this patent is extended or adjusted under 35 U.S.C. 154(b) by 265 days.

(21) Appl. No.: 12/631,914

(22) Filed: Dec. 7, 2009

(65) Prior Publication Data

US 2010/0175976 A1 Jul. 15, 2010

(30) Foreign Application Priority Data

Jan. 13, 2009 (CN) ..... 2009 1 0300172

(51) Int. Cl.
*H01H 13/88* (2006.01)
*H01H 13/83* (2006.01)

(52) U.S. Cl. ..... 200/310; 200/314; 200/317; 29/622

(58) Field of Classification Search ..... 200/5 A, 200/310–317, 341, 512; 29/622; 341/22, 341/28; 345/168–170
See application file for complete search history.

(56) References Cited

U.S. PATENT DOCUMENTS

| | | | | |
|---|---|---|---|---|
| 7,119,296 | B1 * | 10/2006 | Liu et al. | 200/341 |
| 7,465,889 | B2 * | 12/2008 | Nakajima et al. | 200/5 A |
| 7,488,910 | B2 * | 2/2009 | Hong | 200/310 |
| 7,626,133 | B2 * | 12/2009 | Wu et al. | 200/341 |
| 7,705,259 | B2 * | 4/2010 | Kenmochi | 200/514 |
| 7,735,214 | B2 * | 6/2010 | Wu et al. | 29/622 |
| 7,737,375 | B2 * | 6/2010 | Katori et al. | 200/5 A |
| 7,781,690 | B2 * | 8/2010 | Ishii | 200/341 |
| 7,855,347 | B2 * | 12/2010 | Kato et al. | 200/341 |
| 7,866,032 | B2 * | 1/2011 | Wu et al. | 29/622 |
| 7,902,470 | B2 * | 3/2011 | Hosaka | 200/314 |
| 2009/0115640 | A1 * | 5/2009 | Wu et al. | 341/22 |
| 2009/0122016 | A1 * | 5/2009 | Huang | 345/170 |

FOREIGN PATENT DOCUMENTS

| | | | |
|---|---|---|---|
| CN | 1866436 | A | 11/2006 |
| CN | 1897191 | A | 1/2007 |
| CN | 101305438 | A | 11/2008 |

* cited by examiner

*Primary Examiner* — Michael Friedhofer
(74) *Attorney, Agent, or Firm* — Altis Law Group, Inc.

(57) ABSTRACT

A keypad assembly, comprising: a main body made of metal, the main body defining a plurality of slots and the slots enclosing a plurality of pressing buttons thereon, each pressing button defining at least one symbol slot, the main body having a contact surface and a operating surface; and a light-transmissive filling member, the filling member defining a plurality of protruding strips and the protruding strips enclosing a plurality of button areas thereon, each button area having at least one symbol block protruding therefrom, the filling member bonding to the contact surface with the protruding strips and the symbol blocks respectively engaging in the corresponding slots and the symbol slots. A method for making the present keypad assembly is also described.

10 Claims, 5 Drawing Sheets

KEYPAD ASSEMBLY AND METHOD FOR MAKING THE SAME

BACKGROUND

1. Technical Field

The present disclosure relates generally to keypad assemblies and, particularly, to a metallic and light-transmissive keypad assembly and a method for making the keypad assembly.

2. Description of Related Art

Electronic devices with keypads having metallic appearance and are still light-transmissive become increasingly attractive. The keypad assembly can be formed by the following method. A metallic body is punched to form a plurality of small, hollow, and slotted protrusions on the exterior surface. Each slot has a shape such as a numeral or character. The slots are filled with molten transparent resin to form the key panel of the keypad assembly. However, the main body should not be too thin and the slots should not be too narrow. Otherwise, it may be difficult to fill the slots. This restricts the design of the slots.

Therefore, there is room for improvement within the art.

BRIEF DESCRIPTION OF THE DRAWINGS

Many aspects of the keypad assembly and method for making the keypad assembly can be better understood with reference to the following drawings. The components in the drawings are not necessarily to scale, the emphasis instead being placed upon clearly illustrating the principles of the present keypad assembly and method for making the keypad assembly. Moreover, in the drawings, like reference numerals designate corresponding parts throughout the following view.

DETAILED DESCRIPTION

The present keypad assembly is suitable for use in a portable electronic device, e.g., mobile phone and personal digital assistant (PDA).

Figure 1:
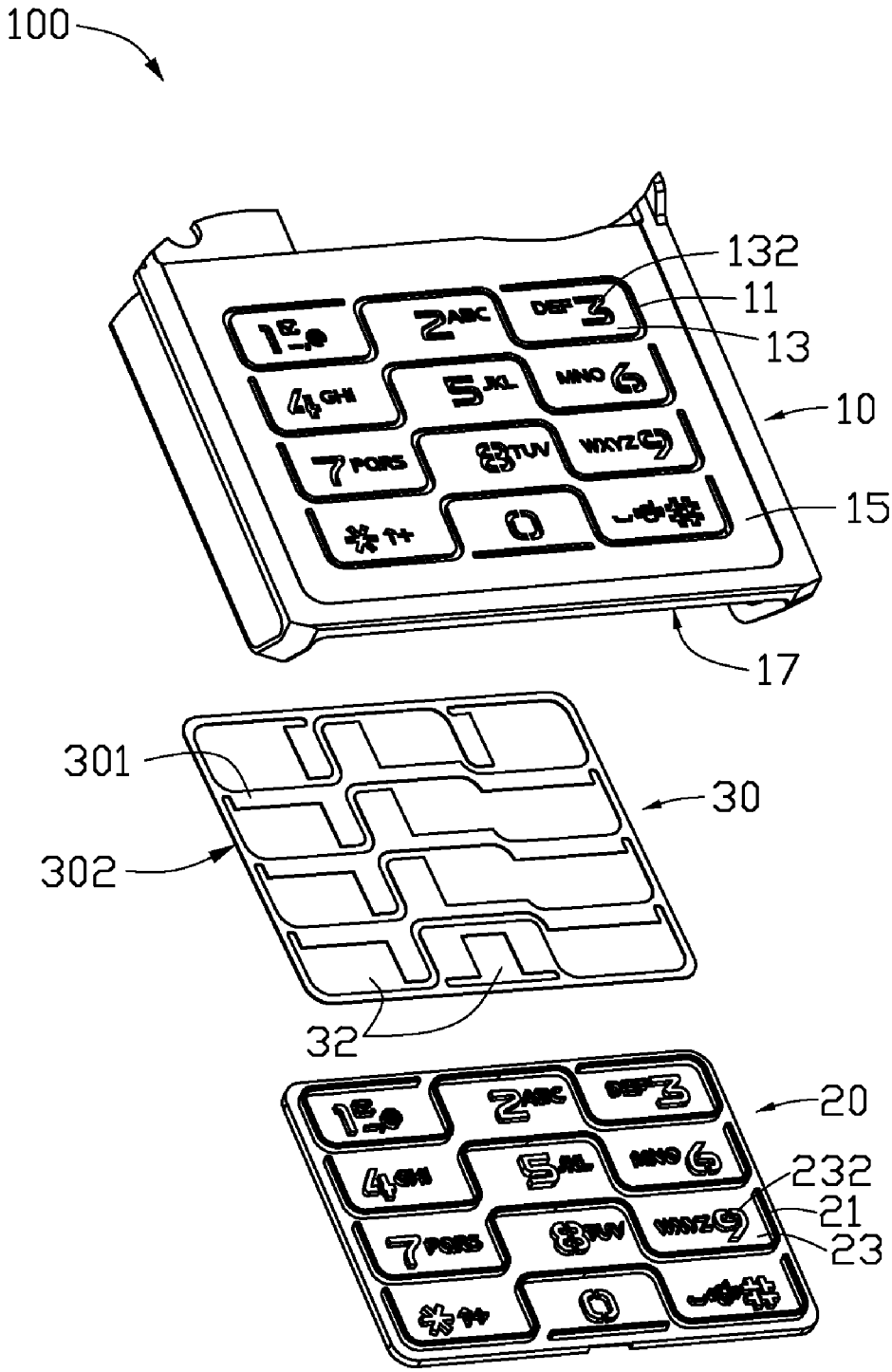
FIG. 1 is an isometric, exploded view of a keypad assembly, in accordance with an exemplary embodiment.

FIG. 1 shows an exemplary keypad assembly 100 including a metallic main body 10, a light-transmissive filling member 20, and a bonding film 30. The filling member 20 is partially filled in the main body 10. The bonding film 30 bonds the main body 10 and the filling member 20.

The main body 10 defines a plurality of curved slots 11. The slots 11 enclose a plurality of semi-enclosed pressing buttons 13. Each of the pressing buttons 13 defines at least one hollowed symbol slot 132. The symbol slot 132 has a symbol shape (such as numeral shape and/or character shape). The main body 10 has an operating surface 15 and a contact surface 17 opposite to the operating surface 15.

The filling member 20 has a plurality of protruding strips 21 formed thereon. The protruding strips 21 are shaped and arranged to correspond with the slots 11. The protruding strips 21 enclose a plurality of button areas 23. The button areas 23 are arranged to correspond to the pressing buttons 13. Each of the button areas 23 has at least one symbol block 232 protruding therefrom. The symbol block 232 is shaped to engage its corresponding symbol slot 132. The filling member 20 can be made of light-transmissive thermoplastic elastomer rubber materials or thermoplastic elastomer plastic materials.

The bonding film 30 has adhesive on its opposite surfaces 301 and 302. The bonding film 30 defines a plurality of through holes 32. The through holes 32 are arranged to correspond to the protruding strips 21 and the symbol blocks 232. The bonding film 30 may be a film having adhesive on two opposite surfaces, such as a double-sided adhesive tape.

Figure 2:
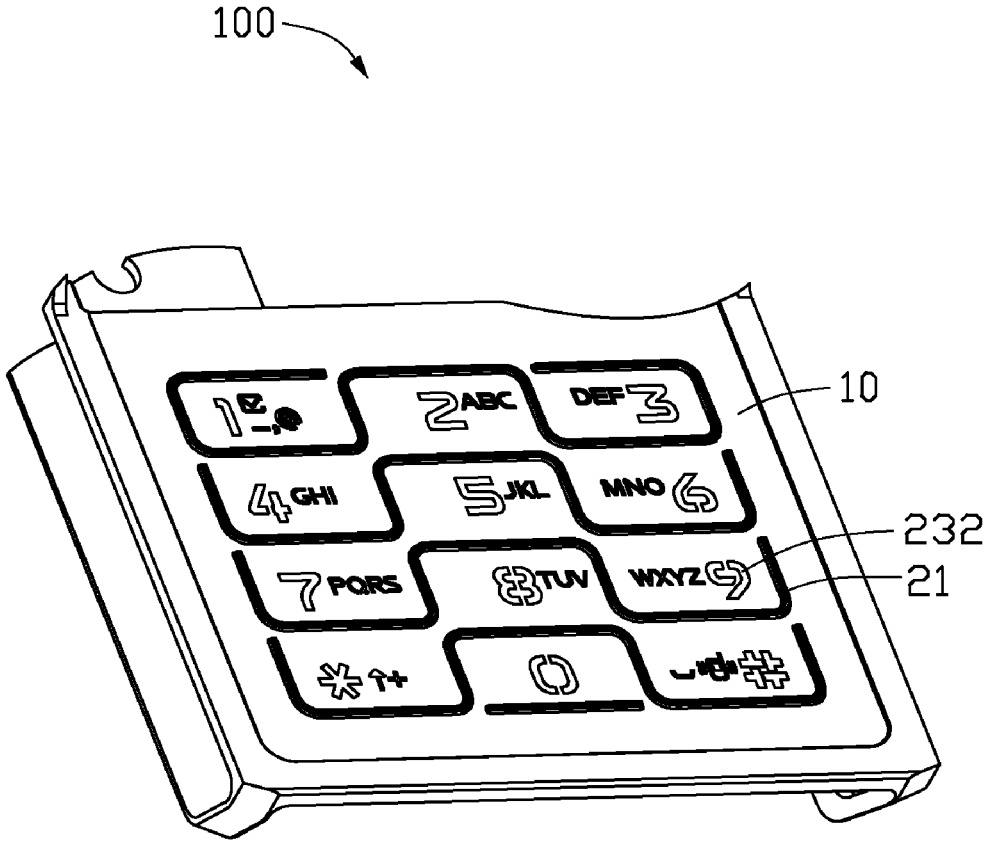
FIG. 2 is an isometric, assembled view of the keypad assembly shown in FIG. 1.
Figure 4:
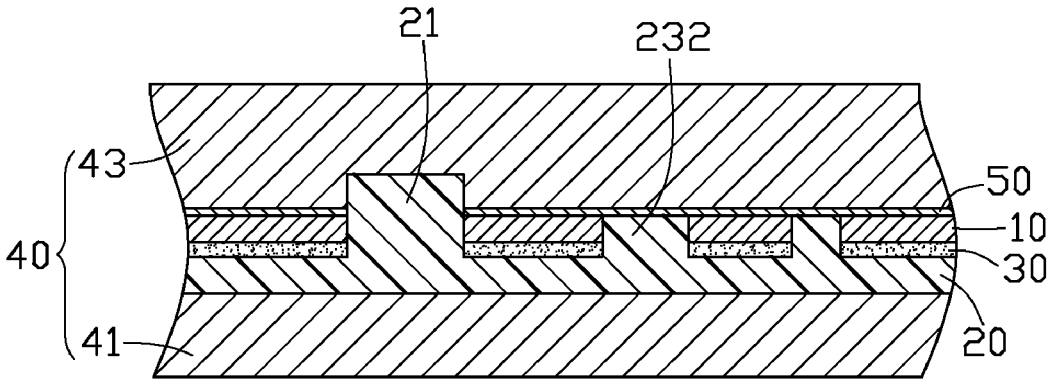
FIG. 4 is a schematic view of another step of a exemplary process for forming the keypad assembly using a form.

Referring to FIGS. 2 and 4, in assembly, the protruding strips 21 and the symbol blocks 232 extend through the through holes 32 and respectively engage in the corresponding slots 11 and symbol slots 132, thereby engaging the filling member 20 to the contact surface 17. For additional reinforcement of the engagement between the filling member 20 and the contact surface 17 of the main body 10, the bonding film 30 is located between the main body 10 and the filling member 20 providing adhesive engagement. The bonding film 30 may strengthen the bonding of the main body 10 and the filling member 20. The protruding strips 21 may extend through and above the operating surface 15 of the main body 10 to achieve a three dimensional appearance. Alternatively, the protruding strips 21 can be coplanar with the operating surface 15.

Figure 3:
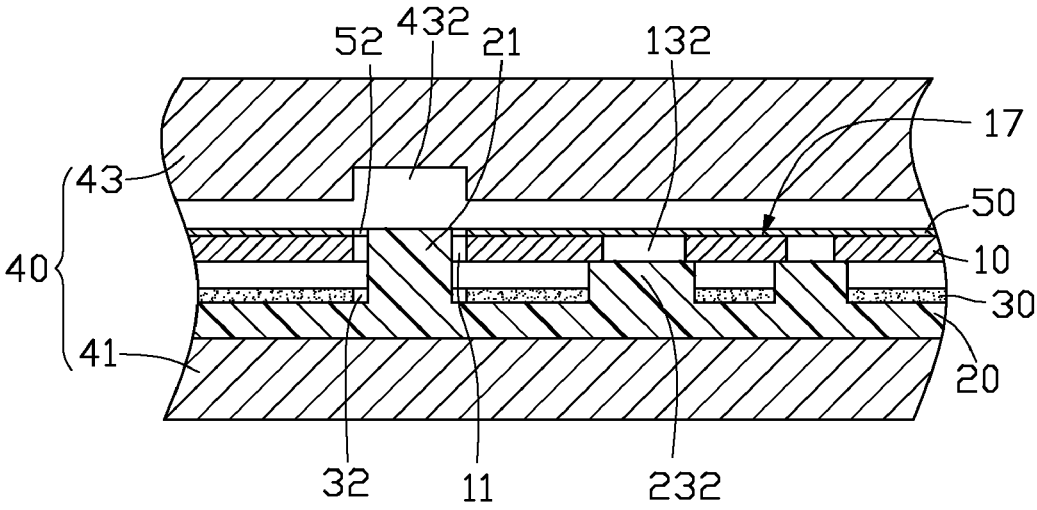
FIG. 3 is a schematic view of a step of a exemplary process for forming the keypad assembly using a form.

Referring to FIGS. 3 and 4, an exemplary method for making the keypad assembly 100 may include the following steps.

A metallic main body 10 is provided. The main body 10 has the structure as described above, including the slots 11 and the symbol slots 132. The main body 10 can be extrusion molded. The slots 11 and the symbol slots 132 may be formed by pressing, laser incision or etching.

A filling member 20 is provided. The filling member 20 has the structure as described above, including the protruding strips 21 and the symbol blocks 232. Prior to a heating step being performed, each protruding strip 21 is taller and narrower and thinner than inside each slot 11, so they are readily received inside the slots 11. Each symbol block 232 is initially wider than its corresponding symbol slot 132 to ensure a proper fit after heating. The filling member 20 can be made by a process, such as injection molding or hot pressing.

A form 40 for hot melting is provided. The mold 40 includes a supporting member 41 and a pressing head 43. The pressing head 43 can be heated. The pressing head 43 defines a plurality of receiving grooves 432 of a depth fully accommodating the protruding strips 21.

The filling member 20 is placed on the supporting member 41. If using the bonding film 30 as described above, then bonding film 30 is provided and adhered to the filling member 20 first, with the protruding strips 21 and the symbol blocks 232 extending through the through holes 32 of the bonding film 30.

The main body 10 is positioned on the filling member 20 with the contact surface 17 facing the filling member 20 and the protruding strips 21 engaging in the slots 11. The symbol blocks 232 are aligned with but not yet received in the corresponding symbol slots 132.

A heat-resistant protective film 50 is provided and adhered to the operating surface 15 of the main body 10. The protective film 50 defines a plurality of bores 52 corresponding in shape and size to the slots 11.

The pressing head 43 is heated and pressed onto the main body 10. Now softened and under the pressure of the pressing head 43, the protruding strips 21 deform and fill the slots 11 and the receiving grooves 432. Accordingly, the symbol blocks 232 fill the symbol slots 132. As such, the filling member 20 and the main body 10 cooperatively form the keypad assembly 100. Alternatively, the protruding strips 21 may directly extend out of the slots 11 and engage in the receiving grooves 432 without any heating and softening.

Once cooled, the filling member 20 achieves a stable form. After that, the keypad assembly 100 is taken out of the mold 40 and the protective film 50 is peeled off.

The keypad assembly 100 has an outer surface comprised of the metallic main body 10 and the light-transmissive filling member 20. Thus, the outer surface has a metallic appearance and good light transmittance.

It should be understood, that the bonding film 30 and/or the protective film 50 can be omitted when the extra strength they provide is deemed unnecessary for the application. The present method for making a keypad assembly 100 overcomes previous restrictions required by the thickness of the metallic main body 10 and/or the width of the symbol slots 132.

Figure 5:
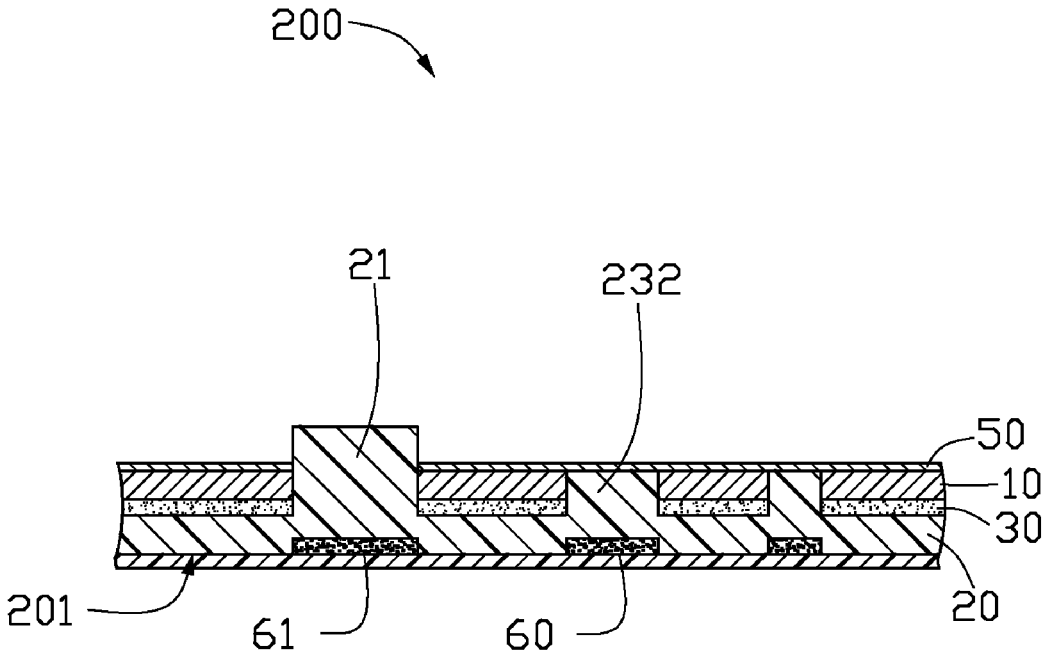
FIG. 5 is a schematic view of a keypad assembly with a decorative film, in accordance with another exemplary embodiment.

Referring to FIG. 5, another keypad assembly 200 according to another exemplary embodiment is similar to the keypad assembly 100 except the keypad assembly 200 further includes a decorative film 60. The decorative film 60 may be, for example, printed with colored patterns 61. The decorative film 60 bonds to the surface 201 of the filling member 20 distal to the main body 10. The patterns 61 align with the protruding strips 21 and the symbol blocks 232. As such, the protruding strips 21 and the symbol blocks 232 can present the colors of the patterns 61.

It should be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A method for making a keypad assembly, comprising the steps of:

providing a main body made of metal, the main body defining a plurality of slots and the slots enclosing a plurality of pressing buttons thereon, each pressing button defining at least one symbol slot, the main body having a contact surface and a operating surface;

providing a light-transmissive filling member, the filling member forming a plurality of protruding strips and the protruding strips enclosing a plurality of button areas thereon, each button area having at least one symbol block protruding therefrom;

providing a form, the form comprising a supporting member and a pressing head;

placing the filling member on the supporting member;

positioning the main body on the filling member with the contact surface facing the filling member and the protruding strips engaging in the slots, the symbol blocks being aligned with the symbol slots; and heating and pressing the pressing head until the symbol blocks are heated and softened, and then deformed to fill the symbol slots.

2. The method for making a keypad assembly as claimed in claim 1, wherein the slots and the symbol slots are formed by pressing, laser incision or etching.

3. The method for making a keypad assembly as claimed in claim 1, wherein the filling member is made of thermoplastic elastomer rubber materials or thermoplastic elastomer plastic materials by injection molding or hot pressing.

4. The method for making a keypad assembly as claimed in claim 1, wherein prior to the heating step, each protruding strip is taller and narrower and thinner than inside each slot; each symbol block is initially wider than its corresponding symbol slot.

5. The method for making a keypad assembly as claimed in claim 1, further comprising prior to placing the filling member on the supporting member, a bonding film defining a plurality of through holes is adhered to the filling member, with the protruding strips and the symbol blocks extending through the through holes.

6. The method for making a keypad assembly as claimed in claim 1, further comprising prior to pressing down the pressing head, a heat-resistant protective film being adhered to the operating surface of the main body, the protective film defining a plurality of bores corresponding in shape and size to the slots.

7. The method for making a keypad assembly as claimed in claim 6, further comprising removing the protective film from the operating surface.

8. The method for making a keypad assembly as claimed in claim 1, wherein the pressing head defines a plurality of receiving grooves of a depth to fully accommodate the protruding strips.

9. The method for making a keypad assembly as claimed in claim 8, wherein the protruding strips being heated to be softened and fill the receiving grooves.

10. The method for making a keypad assembly as claimed in claim 8, wherein the wherein the protruding strips extend through the slots and directly insert into the receiving grooves without being heated and softened.

* * * * *